US006325609B1

(12) United States Patent
Shimada

(10) Patent No.: US 6,325,609 B1
(45) Date of Patent: Dec. 4, 2001

(54) COMPRESSION MOLDING MACHINE FOR POWDER MATERIAL

(75) Inventor: Keiji Shimada, Kyoto (JP)

(73) Assignee: Kikusui Seisakusyo Ltd., Kyoto (JP)

( * ) Notice: Subject to any disclaimer, the term of this patent is extended or adjusted under 35 U.S.C. 154(b) by 0 days.

(21) Appl. No.: 09/333,983

(22) Filed: Jun. 16, 1999

(30) Foreign Application Priority Data

Jul. 29, 1998 (JP) ..... 10-214670

(51) Int. Cl.[7] ..... B30B 11/08

(52) U.S. Cl. ..... 425/140; 425/141; 425/145; 425/149; 425/150; 425/345

(58) Field of Search ..... 425/140, 141, 425/145, 149, 150, 345; 264/40.4, 40.5

(56) References Cited

U.S. PATENT DOCUMENTS 3,910,737 * 10/1975 Shimada et al. ..... 425/140
4,238,431 * 12/1980 Stuben et al. ..... 264/40.5
4,452,579 * 6/1984 Janson ..... 425/140
4,999,151 * 3/1991 Hinzpeter ..... 264/40.4

* cited by examiner

*Primary Examiner*—Nam Nguyen
*Assistant Examiner*—Donald Heckenberg
(74) *Attorney, Agent, or Firm*—Banner & Witcoff, Ltd.

(57) ABSTRACT

A compression molding machine for powdered material is provided with a measuring means which samples a product automatically and measures weight and thickness of the sampled product, a position adjusting means for adjusting a predetermined distance between compressing components, a weight control means which is used alternatively to a basic control means and controls an amount adjusting means so that the measured weight of the product measured by the measuring means becomes approximate to a predetermined reference value of weight, a thickness control means which is used alternatively to the basic control means and controls position adjusting means so that the measured thickness of the product measured by the measuring means becomes approximate to a predetermined reference value of thickness. The compression molding machine also comprises a reference pressure calibration means which calibrates the reference value of pressure.

15 Claims, 11 Drawing Sheets

COMPRESSION MOLDING MACHINE FOR POWDER MATERIAL

FIELD OF THE INVENTION

This invention relates to a compression molding machine for powder material which compresses powder material so as to mold a medical tablet or something like that.

BACKGROUND OF THE INVENTION

Generally it is difficult for a molding machine which produces a plurality of products successively in a short time to measure an amount of powder material before the powder material is molded into a product in spite the products such as tablets are required to have a uniform weight. For a molding machine having an arrangement in which a punch is inserted into a die by a predetermined depth to compress powder material into a product a ratio of the weight of the product to the compressive pressure applied to the product is approximately one to one. In view of the above, compressive pressure acting on the powder material is detected and the amount of the powder material to be filled into the die is automatically controlled so that the detected compressive pressure becomes identical to a reference value of pressure which has previously been calculated in correspond with a target amount of the powder material. In accordance with a method which controls weight of a product indirectly, however, the weight of the product might fluctuate because a punch or a die expands or shrinks due to heat or a flow of the powder material fluctuates even if the compressive pressure is controlled to be identical to the reference value of pressure. Then conventionally the amount of the powder material to be filled into the die is adjusted so that the weight of the product which has been periodically sampled becomes identical to a reference value of weight and a reference value of pressure is calibrated based on compressive pressure measured after the amount of the powder material is adjusted.

Recent demand requires that thickness of products be within a certain range in order to make a process of packing the products smooth. In this case, position of a punch is controlled to make the thickness of a product identical to a reference value of thickness and the reference value of pressure is calibrated based on the compressive pressure when the thickness of the product is within the range.

However, weight and thickness are interconnected. Then if either one of them is controlled, the other would also be affected. As a result, it has conventionally been considered to be difficult to control both weight and thickness together and both of the weight and thickness can not automatically be controlled at once. Therefore, a skilled person adjusts the weight and thickness together manually, which prevents the manufacturing process from being automated. This is one of the factors which prevents productivity from being improved.

SUMMARY OF THE INVENTION

In order to solve the above-mentioned problems, the invention is intended to automate a process of compression molding fully and to provide high quality products constantly by the following process. Weight and thickness of sampled products are measured and both of the weight and thickness of the products are feedback-controlled together by comparing the measured values of weight and thickness with predetermined reference values of weight and thickness respectively.

The compression molding machine for powder material in accordance with the invention comprises, as shown in FIG. 1, a compressing means AA which compresses powder material filled between compressing components so as to mold the powder material into a product by making the compressing components approach each other to a predetermined distance, an amount adjusting means BB which adjusts an amount of the powder material to be filled, a pressure detecting means CC which detects compressive pressure applied to the powder material by the compressing means BB, and a basic control means DD which controls the amount adjusting means BB so that the compressive pressure detected by the pressure detecting means CC becomes approximate to a reference value of compressive pressure which has previously been calculated in accordance with the predetermined reference amount of the powder material, and is characterized by that provided with a measuring means EE which samples the product automatically and measures weight and thickness of the sampled product, a position adjusting means FF which adjusts a predetermined distance between the compressing components, a weight control means GG which is used alternatively to the basic control means DD and controls the amount adjusting means BB so that the weight of the product measured by the measuring means EE becomes approximate to a predetermined reference value of weight, a thickness control means HH which is used alternatively to the basic control means DD and controls the position adjusting means FF so that the thickness of the product measured by the measuring means EE becomes approximate to a predetermined reference value of thickness and a reference pressure calibration means II which calibrates the reference value of pressure based on the pressure measured at a time when both of the measured weight and thickness of the product are within the limits of tolerance set in accordance with the reference value of weight and thickness. The alphabet JJ in FIG. 1 shows a switching element which switches the basic control means DD and the weight control means GG or the thickness control means HH alternatively and the alphabet SK is a signal to switch the switching element JJ.

In accordance with the arrangement, since the product is automatically sampled and feedback-controlled in weight and thickness and the reference value of pressure is calibrated while controlled by the basic control means DD, it is possible to automatically produce high quality products constantly uniform in weight and thickness although the compressing component might expand due to high temperature or flow of powder material might fluctuate. As a result, productivity can be improved and the cost can be decreased because of full-automation.

In order to simplify and stabilize control it is preferable to have an arrangement in which the thickness of the product is controlled by the thickness control means HH after the measured weight of the product is controlled to be within the limits of tolerance of the reference value of weight by the weight control means GG.

Measurement of weight may preferably be represented by that a plurality of products are sampled and average weight and thickness of the sampled products are calculated by the measuring means EE and that the average weight and thickness are utilized as the measured weight and thickness respectively.

In order to carry out automatic operation preferably it is preferable that the products are sampled at predetermined intervals.

In order to stabilize weight control by the weight control means GG it is preferable that a method for controlling the weight control means can be varied in a plurality of steps based on an amount of deviation of the measured weight of the product from the reference value of weight. In order to stabilize thickness control by the thickness control means HH it is preferable that a method for controlling the thickness control means can be varied in a plurality of steps based on an amount of deviation of the measured thickness of the product from the reference value of thickness.

In order to avoid unnecessary calibration of the reference value of pressure and to stabilize control by the basic control means DD it is preferable that a dead zone is provided with the reference value of pressure being a center of the dead zone and that no calibration is conducted to the reference value of pressure by the reference pressure calibration means II if an amount of deviation of the measured pressure from the reference value of pressure is within the dead zone. In this case it is preferable that a plurality of ranges of the dead zone can be set.

In order to meet user's requirements or to deal with various kinds of powder material it is preferable that a method for calibrating the reference value of pressure by the reference pressure calibration means II can be selected from a plurality of predetermined methods.

As mentioned above, in accordance with the invention, the products are automatically sampled and feedback-controlled in weight and thickness and the reference value of pressure is calibrated while controlled by the basic control means. As a result, it is possible to produce automatically high quality products constantly uniform in weight and thickness although the compressing component might expand due to high temperature or the flow of powder material might fluctuate. Therefore, productivity can be improved and the cost can be decreased because of full-automation.

If a single product is sampled, control might be unstabilized because the sampled product might suffer from unexpected changes such as broken or the like. However, if a plurality of products are sampled and average weight and thickness of the sampled products are calculated by the measuring means and the average weight and thickness is utilized as measured weight and thickness respectively, such unexpected changes can be excluded, thereby to improve reliability of the measured data as well as to stabilize control.

If products are sampled at predetermined intervals, it is possible to carry out a molding process automatically.

If the amount adjusting means can be controlled in a plurality of steps based on an amount of deviation of the measured weight of the product from the reference value of weight, or the position adjusting means can be controlled in a plurality of steps based on an amount of deviation of the measured thickness of the product from the reference value of thickness, it is possible to stabilize weight and thickness control by means of the weight control means and thickness control means.

If a dead zone is provided with the reference value of pressure being a center of the dead zone and the reference value of pressure is not calibrated by the reference pressure calibration means when an amount of deviation of the measured pressure from the reference value of pressure is within the dead zone, it is possible to stabilize control by the basic control means even though there is no correlation between pressure and weight. Especially in this case if it is possible to set a plurality of ranges of the dead zone, optimal control can be tailored to a various kinds of situation at a user's request.

If a method for calibrating the reference value of pressure by the reference pressure calibration means can be selected from a plurality of predetermined methods, it is possible to meet various users' requirements and to deal with various kinds of powder material.

DETAILED DESCRIPTION OF THE PREFERRED EMBODIMENTS

A preferred embodiment of the invention will now be described in detail with reference to FIGS. 2 to 11. A compression molding machine for powder material in accordance with the embodiment is to mold medical tablets and comprises, as shown in FIG. 2, a machine body 1 which molds tablets O, a measuring equipment 2 as a measuring means which samples the tablets O as a product which has been molded and conveyed by the machine body 1 and measures values of each tablet O and a control unit 11 which controls each value for molding the tablet O by feedback of the measured values.

Figure 1:
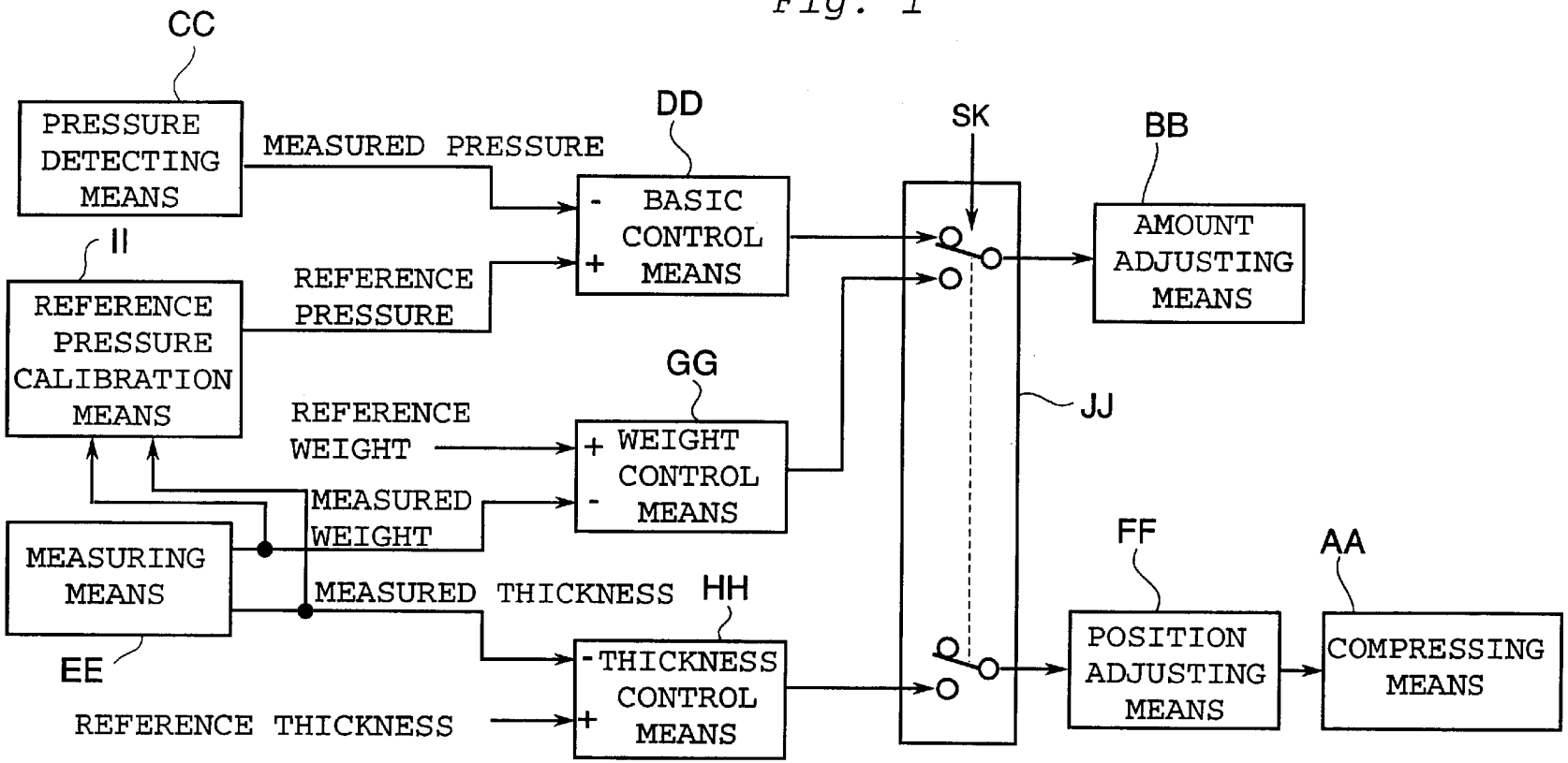
FIG. 1 is a general block diagram showing a block of a function in accordance with the invention.
Figure 2:
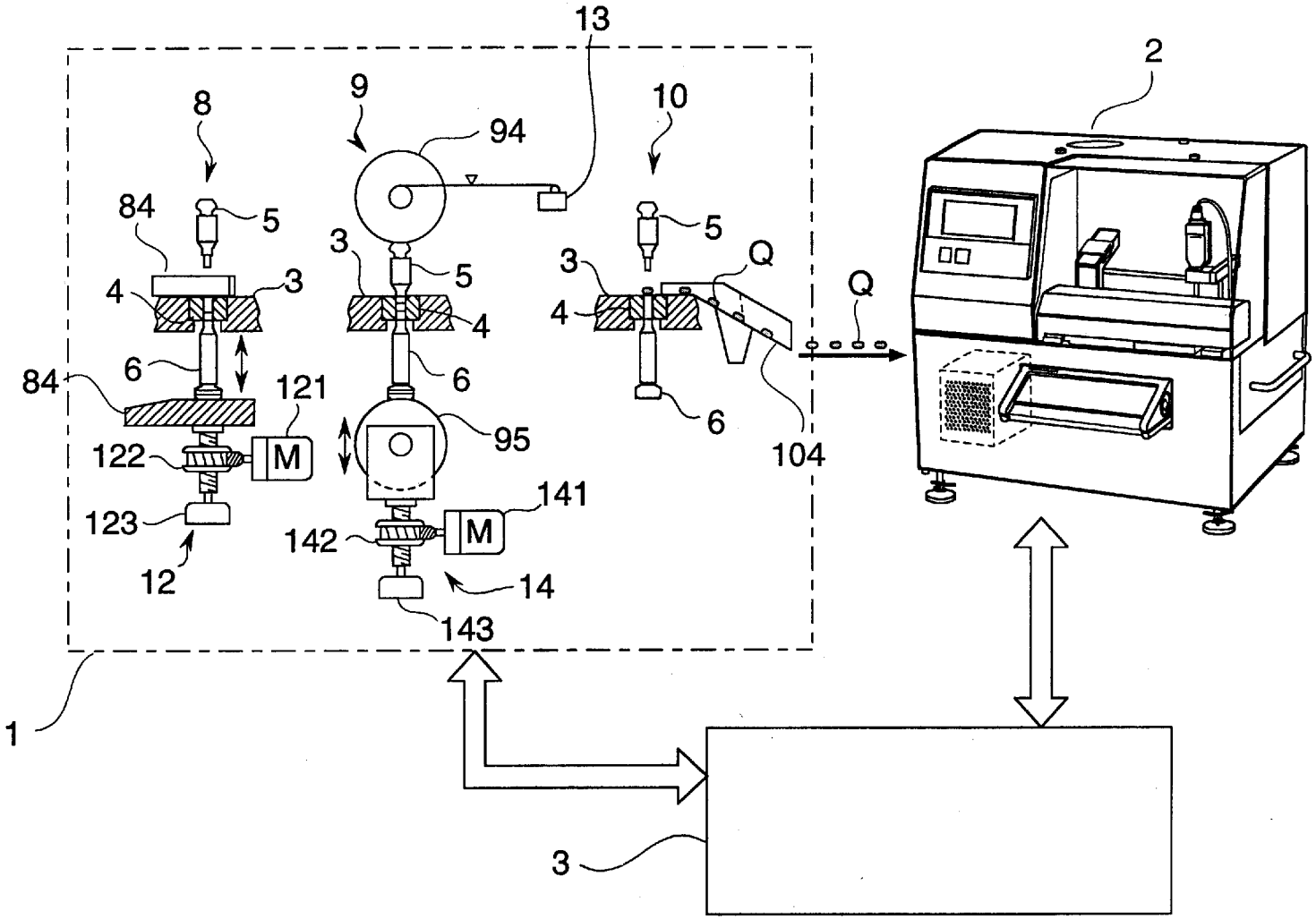
FIG. 2 is a schematic view of an arrangement showing an embodiment of the invention.
Figure 3:
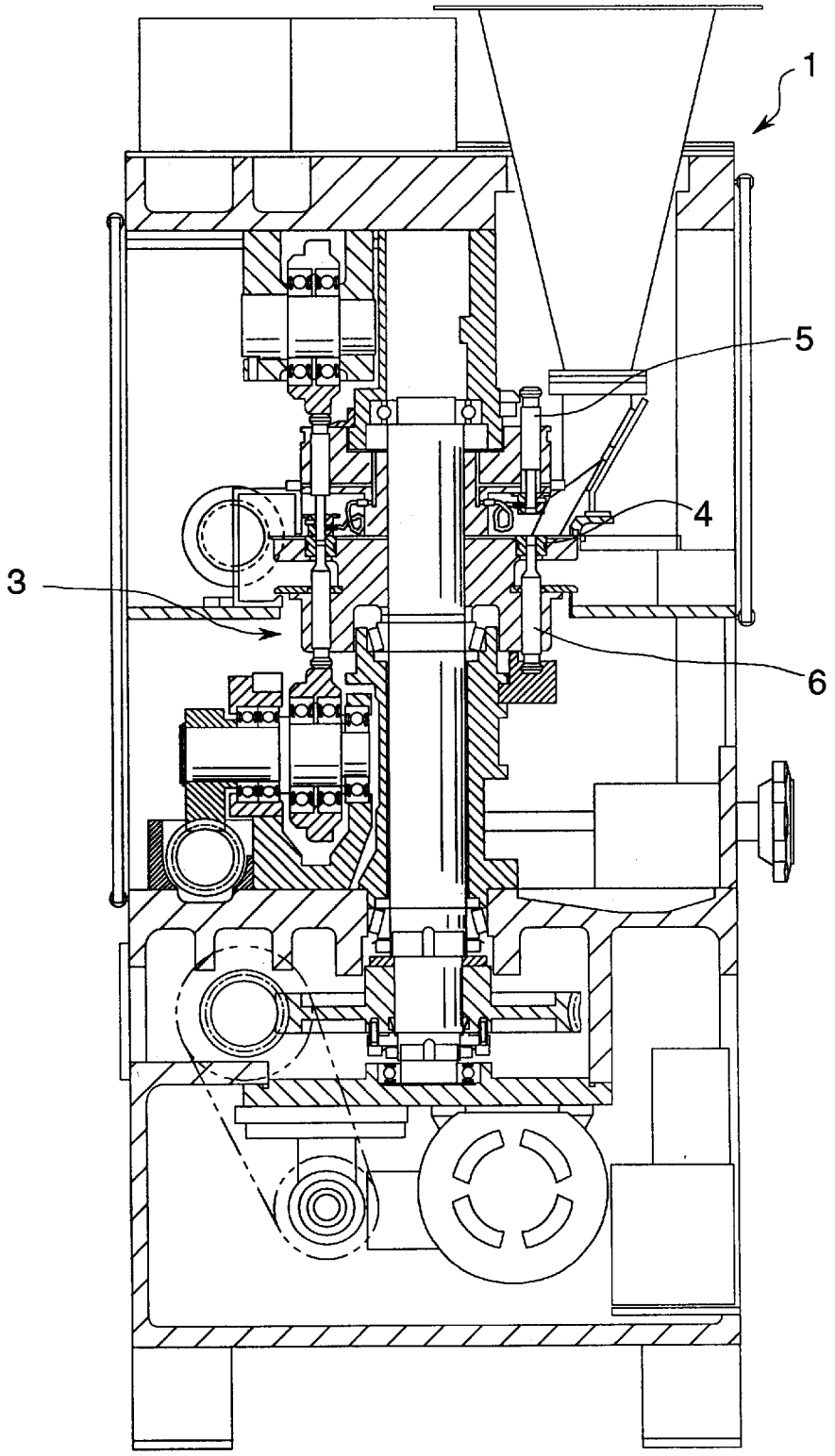
FIG. 3 is a cross sectional view showing a machine body of the embodiment.
Figure 4:
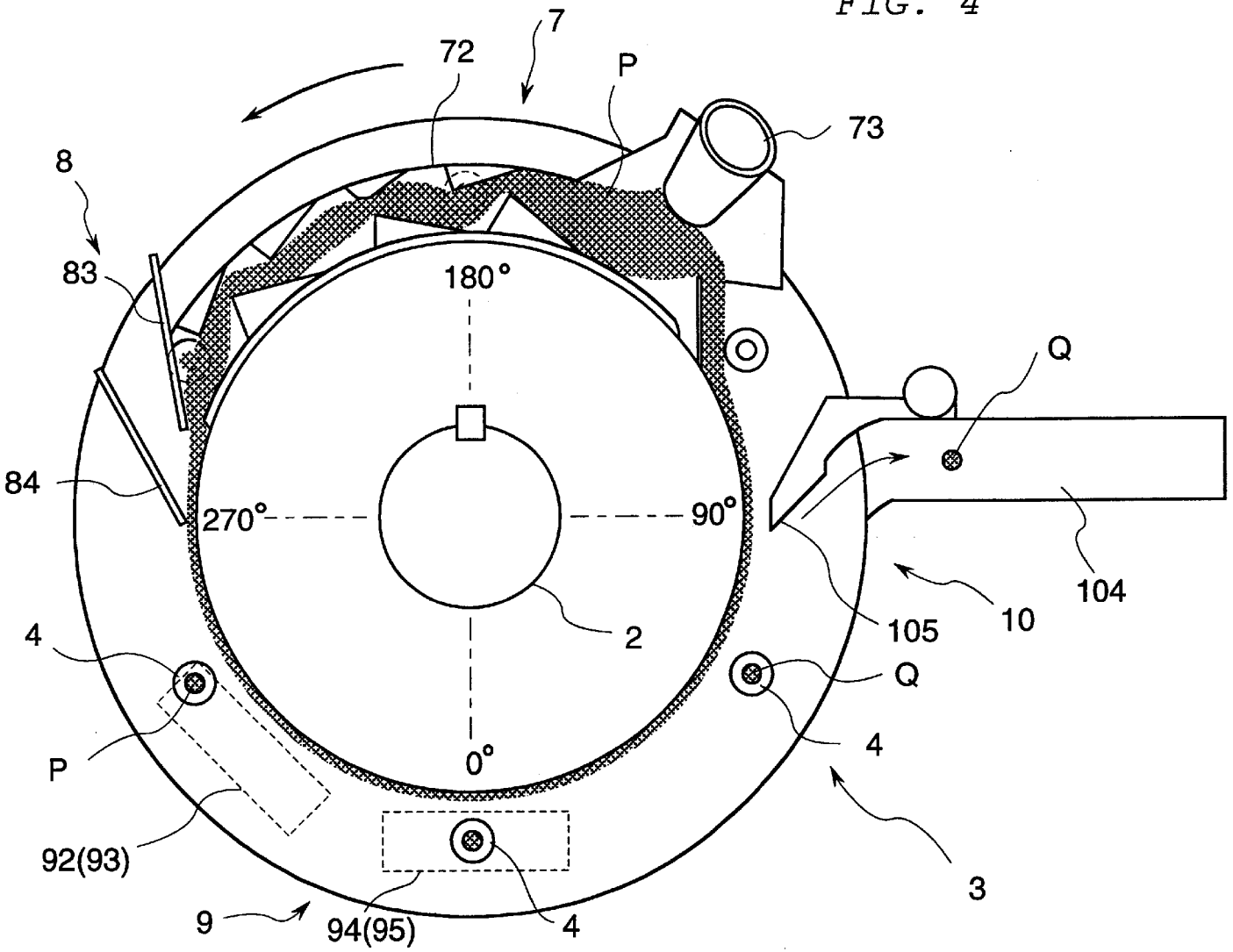
FIG. 4 is a schematic plane view showing a rotary table of the machine body in accordance with the embodiment.

The machine body 1 is of a rotary type as shown in FIGS. 2 to 4 wherein a plurality of cylindrical dies 4 are detachably provided at a predetermined pitch on a rotary table 3 which is arranged horizontally rotatable and above and below each of the die 4 held are an upper punch 5 and a lower punch 6 as a compressing component so that the lower face of the upper punch 5 and the upper face of the lower punch 6 can be inserted into the die 4 and vertically slidable with each of the axis aligned with that of the die 4. The dies 4, upper punches 5 and lower punches 6 are thus arranged so as to rotate synchronous with the rotary table 3.

The machine body 1 has an arrangement in which the rotary table 3 is provided with a filling portion 7, a leveling portion 8, a compressive molding portion 9 and an unloading portion 10 sequentially along the direction of rotation.

The filling potion 7 introduces powder material P which has been supplied on the rotary table 3 into the die 4 through a feed shoe 72 by lowering the lower punch 6. The powder material P is supplied on the rotary table 3 by means of a powder material supplying mechanism 73.

The leveling portion 8 raises the lower punch 6 to a predetermined level by means of an amount setting rail 82 and removes the powder material P which has been overflowed from the die 4 due to a rise of the lower punch 6 by means of leveling plates 83, 84. In addition, an amount adjusting means 12 is also provided in order to adjust the amount of the powder material P to be filled. The amount adjusting means 12, as shown in FIG. 2, has an arrangement in which the amount of the powder material P to be filled into the die 4 can be adjusted by raising or lowering the lower punch 6 which is caused by an up-and-down movement of the amount setting rail 82. More concretely, it comprises a motor 121, a transforming mechanism 122 which transforms a rotation of the motor 121 into an up-and-down movement of the amount setting rail 82 via a gear row and a potentiometer 123 as a position sensor which detects an amount of the up-and-down movement.

The compressive molding portion 9 lowers the upper punch 5 so as to insert a lower face thereof into the die 4, compresses preliminarily the powder material P filled in the die 4 with the upper and lower punches 5, 6 each of whose lower and upper faces is inserted into the die 4 pushed from upside and downside by upper and lower preliminary compression rollers 92, 93 and compresses the powder material P in the die 4 with the upper and lower punches 5, 6 pushed from upside and downside by upper and lower compression rollers 94, 95. In this embodiment, as shown in FIG. 2, the upper compression roller 94 is provided with a pressure sensor 13 as a pressure detecting means which detects compressive pressure. The lower compression roller 95 is provided with a position adjusting means 14 which can adjust the vertical position of the lower compression roller 95. The position adjusting means 14 comprises a motor 141, a transforming mechanism 142 which transforms rotation of the motor 141 into an up-and-down movement of the lower compression roller 95 via a gear row and a potentiometer 143 as a position sensor which detects an amount of the up-and-down movement.

The unloading portion 10 rises the upper punch 5 so that the lower face of the upper punch 5 can be drawn from the die 4, urges the lower punch 6 upward so that the tablet O in the die 4 can be completely pushed out of the die 4 and guides the tablet O aside so as to introduce the tablet O into a shoot 104 by making use of a guide plate 105.

Thus arranged machine body 1 molds powder material P into a tablet O successively, for example, 1 per 30 milliseconds by making use of the upper and lower punches 5, 6 and the die 4 with the rotary table 3 rotated.

The measuring equipment 2 comprises a weight measuring mechanism, a thickness measuring mechanism and a hardness measuring mechanism not shown in figures and automatically measures weight, thickness and hardness of the tablet O which is sampled at predetermined intervals and guided by the shoot 104. The measuring equipment 2 may be a suitable one such as disclosed in Japanese Patent Publication No. 7-12634 by the same applicant as the present claimed invention. The measuring equipment 2 has an arrangement in which each of the sampled tablets O is sequentially conveyed to the weight measuring mechanism, the thickness measuring mechanism and the hardness measuring mechanism each of which is arranged on a tablet conveying rail not shown by a tablet conveying means. Measured data are automatically processed and memorized by an internal controller and then displayed on a display or a printer, or they can be transferred to another equipment such as a first controller 111 of the control unit 11 shown in FIG. 5 through a serial signal line SL1 which is making use of RS232C. Especially in this embodiment since it is possible to calculate an average value of the measured data by measuring a plurality of tablets O, the average value of the plurality of measured data is utilized as a measured weight value or a measured thickness value of the tablet O.

Figure 5:
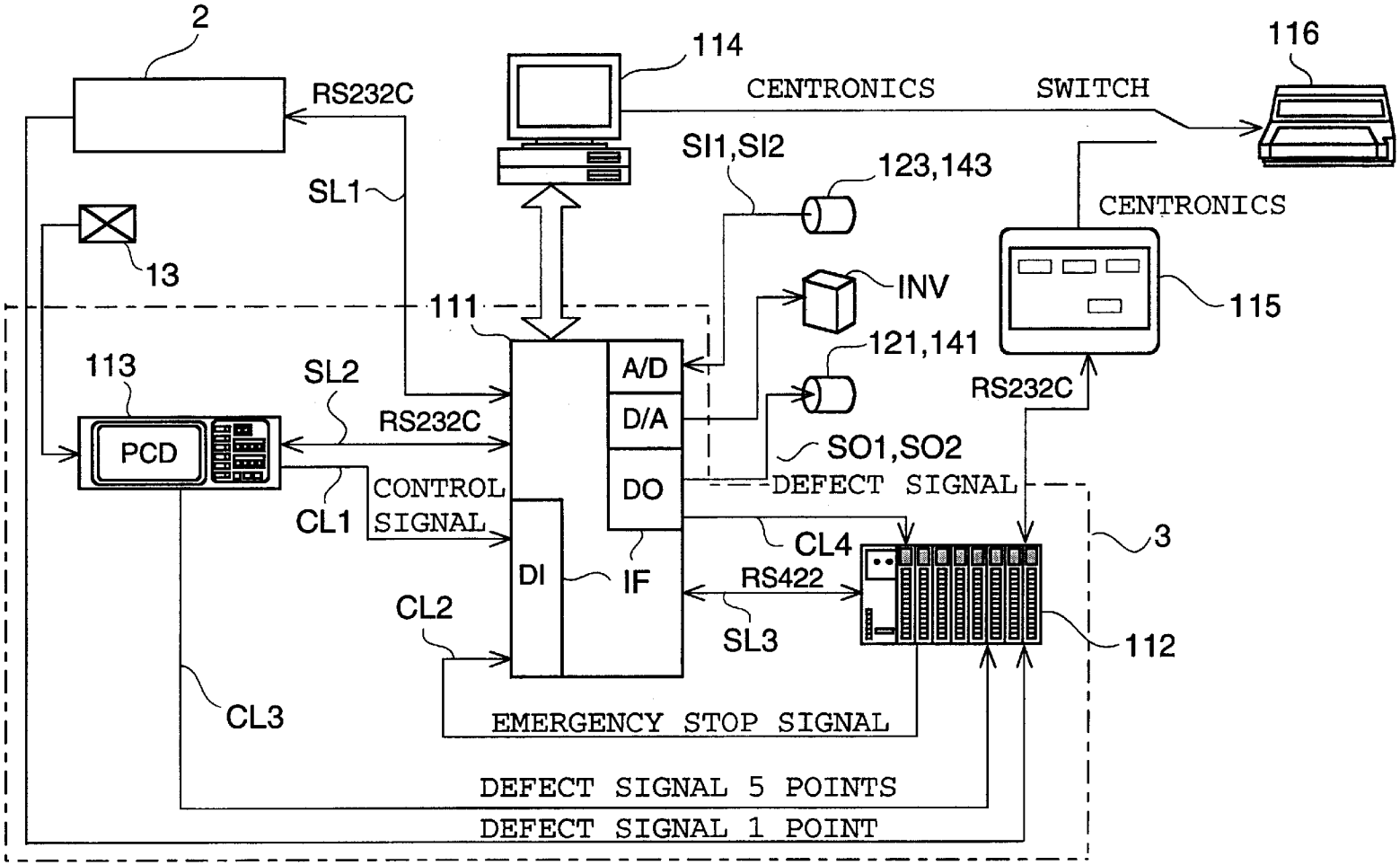
FIG. 5 is a schematic view showing an arrangement of each element in accordance with the embodiment.
Figure 6:
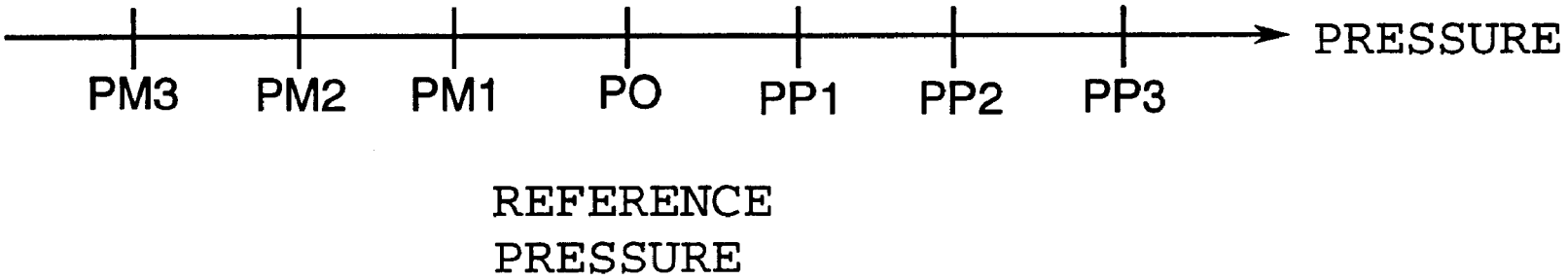
FIG. 6 is a chart showing a relationship of each value (an upper value of starting control, an upper excluding value, an upper limit value of control range, a lower value of starting control, a lower excluding value and a lower limit value of control range) and a reference value of pressure in accordance with the embodiment.

The control unit 11 comprises mainly, as shown in FIG. 5, the first controller 111 which is called as a microcomputer and has a CPU, a memory and input and output interface IF, a second controller 112 as a sequencer and a third controller 113 into which a signal from the pressure sensor 13 is input and which processes pressure data and these first, second and third controllers 111, 112 and 113 are connected each other by serial signal lines SL2, SL3 or control signal lines CL1, CL2, CL3 and CL4 so as to be able to coact. The control unit 11 is provided with a variety of interfaces and is expandable if connected to a personal computer 114, a display 115, a printer 116 or a host computer not shown. The first controller 111 outputs a control signal SO1 of the motor 121 which drives the amount setting rail 82 vertically and inputs a detected signal SI1 output from the potentiometer 123 which detects the amount of an up-and-down movement of the amount setting rail 82 so as to form a local feedback loop. At this time the control unit 11 serves as a roll of a basic control means and a weight control means both of which control the amount adjusting means 12. Similarly the first controller 111 outputs a control signal SO2 of the motor 141 which drives the lower compression roller 95 vertically and inputs a detected signal SI2 output from the potentiometer 143 which detects the amount of an up-and-down movement of the lower compression roller 95 so as to form a local feedback loop. At this time the control unit 11 serves as a roll of a thickness control means which controls the position adjusting means 14.

Next, operation of the compression molding machine for powder material will now be described. Ordinarily the control unit 11 carries out basic control which feedback-controls the amount adjusting means 12 in order to serve as a basic control means so that a reference value of pressure PO becomes approximate to a reference value of pressure PO which has previously been calculated corresponding to a target amount of the powder material and produces the tablet O. The basic control may be conducted in a suitable manner such as disclosed in Japanese Patent Publication No. 60-277334 or 4-222626 by the same applicant as the present claimed invention. More specifically, the third controller 113 measures compressive pressure several times when an appropriate tablet O is obtained and calculates and sets a reference value of pressure PO automatically based on the standard deviation of each pressure. The third controller 113 also automatically sets an upper-value of starting control PP1, an upper excluding value PP2 and an upper limit value of control range PP3 in an ascending order and a lower value of starting control PM1, a lower excluding value PM2 and a lower limit value of control range PM3 in a descending order with the reference value of pressure PO being a center value. The amount adjusting means 12 is controlled based on a comparison of the measured pressure with the reference value of pressure PO, the upper and lower values of starting control PP1, PM1, the upper and lower excluding values PP2, PM2 and the upper and lower limit values of control range PP3, PM3. More specifically, if the measured pressure is between the lower value of starting control PM1 and the upper value of starting control PP1, no control is conducted.

If the measured pressure exceeds the upper value of starting control PP1 or is under the lower value of starting control PM1, the amount adjusting means 12 is controlled. If the measured pressure exceeds the upper excluding value PP2 or the upper limit value of control range PP3 or is under the lower excluding value PM2 or the lower limit value of control range PM3, no control is conducted because it is considered to be an error and the machine body 1 may be stopped to operate depending on conditions.

In addition to the above-mentioned basic control, this embodiment has a following arrangement. The tablet O is automatically taken into the measuring equipment 2 at predetermined intervals and both of the weight and the thickness thereof are measured. The amount adjusting means 12 is feedback-controlled (weight-controlled) based on the measured data so that the weight of the tablet O becomes equal to the predetermined reference value of weight. The position adjusting means 14 is also feedback-controlled (thickness-controlled) so that the thickness of the tablet O becomes equal to the predetermined reference value of thickness. Then the above-mentioned reference value of pressure PO is calibrated based on the compressive pressure value acting on the powder material which is detected by the pressure sensor 13 when both of the weight and the thickness are generally identical to the reference values of weight and thickness respectively.

Figure 7:
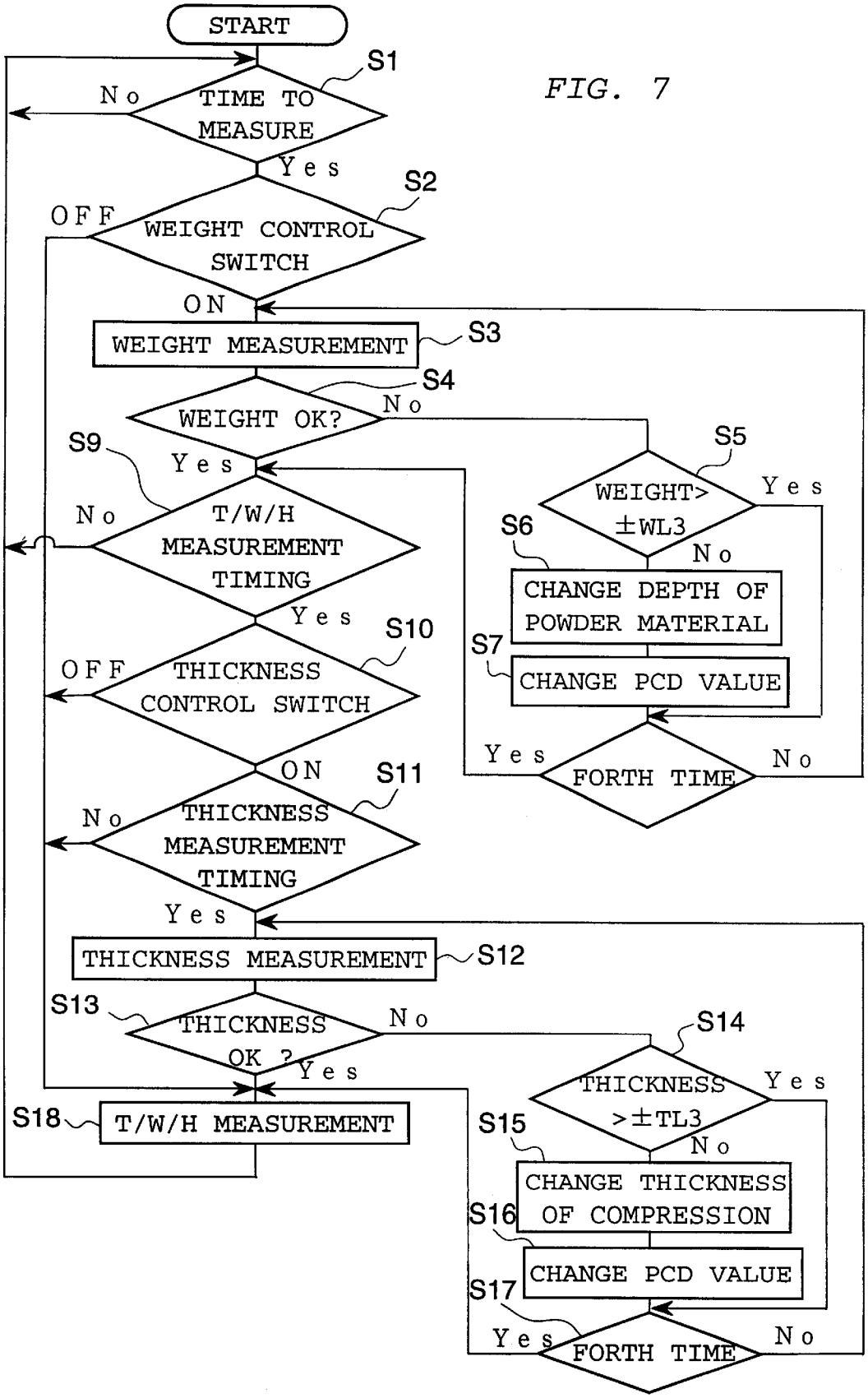
FIG. 7 is a control flow chart mainly showing weight and thickness control of the embodiment.

A control flow of the weight and thickness control will now be described based on a flow chart shown in FIG. 7. The basic control can be interrupted only when necessary, although it is conducted parallel to the control flow.

Step 1 S1 is a routine to wait for a time when a measurement is to be conducted. A pulse generator, not shown, which generates a pulse at predetermined intervals or a timer mechanism which is incorporated in a personal computer or a microcomputer may be used to recognize the time when a measurement is to be conducted. It is a matter of course that a measurement can be conducted any time at a user's request. If recognized as the time to conduct a measurement, then go to Step 2 S2. If no, then return to the start and keep in a state of waiting.

Step 2 S2 refers a value of a weight control switch not shown. If the value of the switch is on, then go to Step 3 S3. If the value of the switch is off, then go to Step 18 S18. The weight control switch is provided for a user to select whether weight control is to be conducted or not.

Step 3 S3 through Step 7 S7 are conducted repeatedly (up to four times) until the measured weight of the tablet O becomes approximate equal to the reference value of weight.

Step 3 S3 measures the weight of the tablet O by means of the measuring equipment 2. Then go to Step 4 S4.

Step 4 S4 judges whether the measured weight is within the limits of tolerance (Xd−WL1 through Xd+WL1) set with the reference value of weight being a center of the dead zone, where Xd represents the reference value of weight. If the measured weight is within the limits of tolerance, then go to Step 9 S9, or else go to Step 5 S5.

Step 5 S5 judges whether the measured weight is within a controllable range (Xd−WL3 through Xd+WL3). If the measured weight is within the controllable range, then go to Step 6 S6, or else go to Step 8 S8 without conducting any control.

Step 6 S6 interrupts the basic control, then controls the amount adjusting means 12 in accordance with deviation of the measured weight from the reference value of weight and adjusts the amount of powder material to be filled into the die 4. Step 6 S6 acts as the weight control means. Then go to Step 7 S7. Concrete processes of Step 6 S6 will be described later.

Step 7 S7 calibrates the reference value of pressure PO in accordance with the measured pressure which has been changed in Step 6 S6 by adjusting the amount of the powder material to be filled. Then the basic control is resumed and go to Step 8 S8. Step 7 S7 acts as a reference pressure calibration means. Concrete processes of Step 7 S7 will be described later.

Step 8 S8 judges how many times the weight control in accordance with the above-described Step 3 S3 through Step 7 S7 has been conducted successively. If it is the forth time, then go to Step 9 S9, or else go back to Step 3 S3.

Steps 9, 10 and 11 S9, S10, S11 judge whether a condition is ready or not to conduct thickness control. In other words, if judged as a timing to conduct thickness measurement due to a thickness control switch not shown being on, then go to Step 12 S12, or else go to Step 18 S18. The thickness control switch is provided for a user to select whether thickness control is conducted or not.

Step 12 S12 through Step 16 S16 are conducted repeatedly (up to four times) until the measured thickness of the tablet O becomes approximate equal to the reference value of thickness.

More specifically, Step 12 S12 measures the thickness of the tablet O by means of the measuring equipment 2. Then go to Step 13 S13.

Step 13 S13 judges whether the measured thickness is within the limits of tolerance (XTd−TL1 through XTd+TL1) of the reference value of thickness. If the measured thickness is within the limits of tolerance, then go to Step 18 S18, or else go to Step 14 S14.

Step 14 S14 judges whether the measured thickness is within a controllable range (XTd−TL3 through XTd+TL3). If the measured thickness is within the controllable range, then go to Step 15 S15, or else go to Step 17 S17 without conducting any control.

Step 15 S15 interrupts the basic control, then controls the position adjusting means 14 in accordance with the deviation of the measured thickness from the reference value of thickness and adjusts the vertical position of the lower compression roller 95. Step 15 S15 acts as the thickness control means. Then go to Step 16 S16. Concrete processes of Step 15 S15 will be described later.

Step 16 S16 calibrates the reference value of pressure PO in accordance with the compressive pressure which has been changed in Step 15 S15 by adjusting the vertical position of the lower compression roller 95. Then the basic control is resumed and go to Step 17 S17 . Step 16 S16 acts as the reference pressure calibration means. Concrete processes of Step 16 S16 will be described later.

Step 17 S17 judges how many times the thickness control in accordance with the above-described Step 12 S12 through Step 15 S15 has been conducted successively. If it is the forth time, then go to Step 18 S18, or else go back to Step 12 S12.

Step 18 S18 measures thickness, weight and hardness of the tablet O by means of the measuring equipment 2. Step 18 S18 is provided in order to obtain measured data of the tablet O even though any weight and thickness control is not conducted. And then go back to Step 1 S1 again and wait for the next time to conduct measurement.

Figure 8:
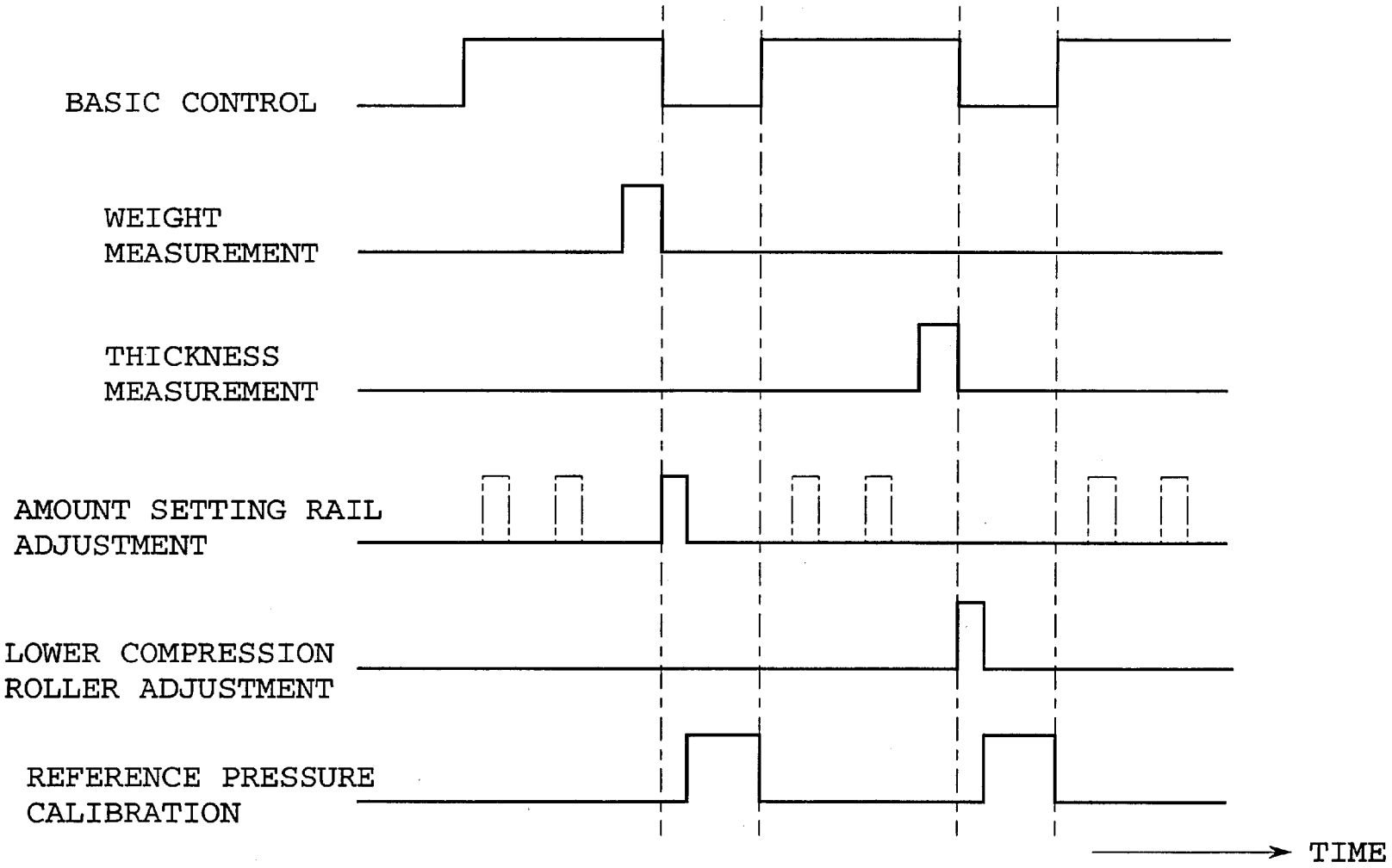
FIG. 8 is a control timing chart of the embodiment.

Generally, the control unit 11 controls as described above. FIG. 8 shows one example of a timing chart when the above-described control is conducted. In each of the graphs shown in FIG. 8, "1" shows duration while control or measurement is conducted and "0" shows duration while no control or measurement is conducted. In the graph of the amount setting rail adjustment shown in FIG. 8, a broken line shows the basic control whereas a solid line shows the weight control.

Figure 9:
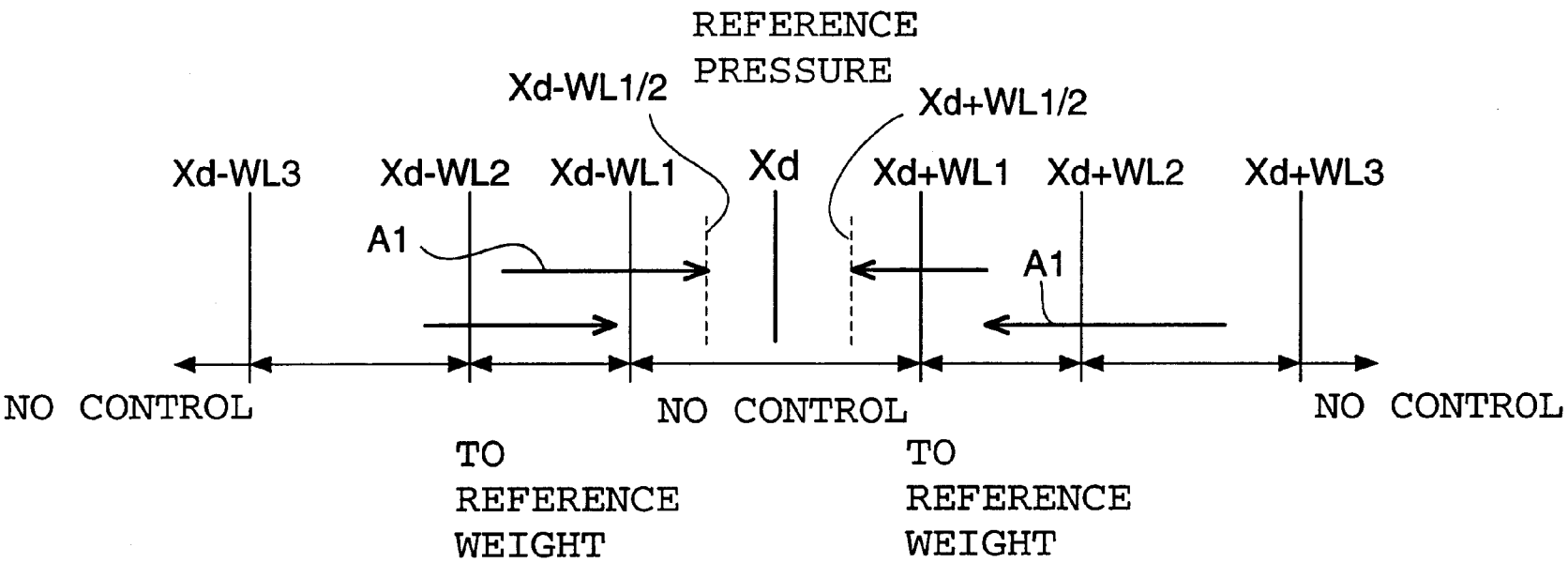
FIG. 9 is a schematic chart showing target values of weight control in accordance with the embodiment.

Next, the control conducted in Step 6 S6 will now be described with reference to FIG. 9. Step 6 S6 controls the amount adjusting means 12 as described above in accordance with the deviation of the measured weight Xave from the reference value of weight Xd and adjusts the amount of the powder material to be filled into the die 4. More concretely, a method of the feedback control is varied in steps based on an amount of the deviation of the measured weight Xave from the reference value of weight Xd.

If the measured weight Xave is within a first range (Xd−WL2 through Xd−WL1 or Xd+WL1 through Xd+WL2) which is set adjacent to the limits of tolerance, in other words, if $$Xd-WL1 \leqq Xave < Xd-WL2,$$

or $$Xd+WL1 < Xave \leqq Xd+WL2,$$

then the amount setting rail 82 is vertically moved by an amount W (unit 0.01 mm) expressed by the next expression (1) or (2).

$$W=\{(Xd-WL1/2)-Xave\}/2Wo \quad (1)$$

(in case $Xd-WL1 \leqq Xave < Xd-WL2$)

$$W=\{(Xave-(Xd+WL1/2)\}/2Wo \quad (2)$$

(in case $Xd+WL1 < Xave \leqq Xd+WL2$), where Wo represents a calibration value per 0.005 mm depth of the powder material filled.

In this case, if the measured weight Xave is in an upper part of the first range, namely, between Xd+WL1 and Xd+WL2, the feedback control is conducted to make the measured weight Xave approach a value Xd+WL1/2 and if the measured thickness Xave is in a lower part of the first range, namely, between Xd−WL2 and Xd−WL1, the feedback control is conducted to make the measured weight Xave approach a value Xd−WL1/2.

In addition, if the measured weight Xave is within a second range (Xd−WL3 through Xd−WL2 or Xd+WL2 through Xd+WL3) which is set adjacent to the first range, in other words, if $$Xd-WL3 \leqq Xave < Xd-WL2$$

or $$Xd+WL2 < Xave \leqq Xd+WL3,$$

then the amount setting rail 82 is vertically moved by the amount W (unit 0.01 mm) expressed by the next expression (3).

$$W=(|Xd-Xave|/2Wo)/2 \quad (3)$$

In this case the feedback control is conducted so as to transfer the amount which is half of the difference between the measured weight Xave and the reference value of weight Xd.

A range exceeding an upper limit value Xd+WL3 of an upper part of the second range or is under a lower limit value Xd−WL3 of a lower part of the second range is set as out of control. The reason why the method of the control is varied in steps is to prevent the amount setting rail 82 from moving vertically quite a lot at once and to prevent hunting so as to improve control stability. An arrow A1 in FIG. 9 schematically shows a change of the measured weight controlled by this control. The base end of the arrow A1 shows the measured weight Xave and the front end thereof shows a target value to be controlled, where each of WL1, WL2 and WL3 is defined as, for example, δ, 2δ and 3δ respectively, where δ is reference standard deviation of tablet weight.

Figure 10:
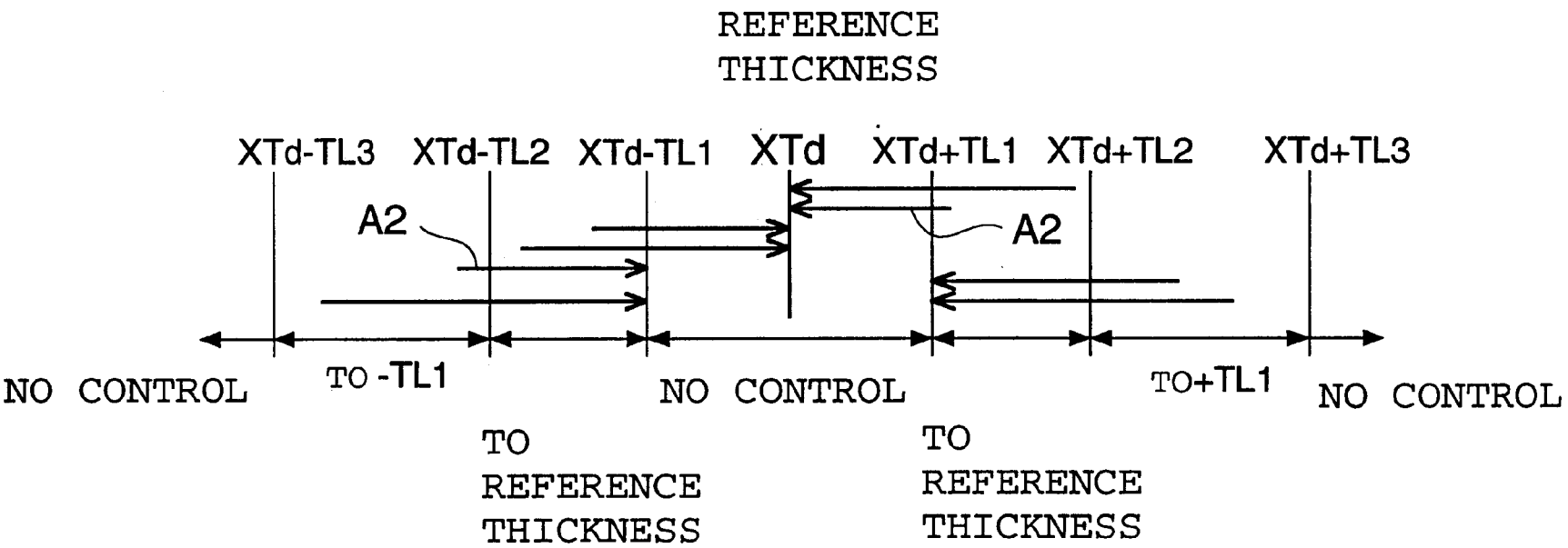
FIG. 10 is a schematic chart showing a target values of thickness control in accordance with the embodiment.

Next, the control conducted in Step 15 S15 will now be described with reference to FIG. 10. The control conducted in Step 15 S15 is fundamentally the same as that of Step 6 S6 except for an object to be controlled is different. More specifically, a method of the feedback control is varied in steps based on an amount of the deviation of the measured thickness XTave from the reference value of thickness XTd.

If a measured thickness XTave is within a first range (XTd−TL2 through XTd−TL1 or XTd+TL1 through XTd+TL2) which is set adjacent to the limits of tolerance, in other words, if $$XTd-TL1 \leqq XTave < XTd-TL2$$

or $$XTd+TL1 < XTave \leqq XTd+TL2,$$

then the lower compression roller 95 is moved downward by an amount T (unit:mm) expressed by the next expression (4).

$$T=XTd-XTave \quad (4)$$

In this case, the feedback control is conducted so as to make the measured thickness XTave approach the reference value of thickness XTd.

In addition, if the measured thickness XTave is within a second range (XTd−TL3 through XTd−TL2 or XTd+TL2 through XTd+TL3) which is set adjacent to the first range, in other words, if $$XTd-TL3 \leqq XTave < XTd-TL2$$

or $$XTd+TL2 < XTave \leqq XTd+TL3,$$

then the lower compression roller 95 is moved downward by an amount T (unit:mm) expressed by the next expression (5) or (6).

If $XTd-TL3 \leqq XTave < XTd-TL2$, then $$T=(XTd-TL1)-XTave \quad (5)$$

If $XTd+TL2 < Xd \leqq XTd+TL3$, then $$T=(XTd+TL1)-XTave \quad (6)$$

In this case, if the measured thickness XTave is in an upper part of the second range, namely, between XTd+TL2 and XTd+TL3, the feedback control is conducted to make the measured thickness XTave approach the upper limit value XTd+TL1 of the tolerance and if the measured thickness XTave is in a lower part of the second range, namely, between XTd−TL3 and XTd−TL2, the feedback control is conducted to make the measured thickness XTave approach the lower limit value XTd−TL1 of the tolerance.

A range exceeding the upper limit value Xtd+TL3 of the upper part of the second range or under the lower limit value XTd−TL3 of the lower part of the second range is set as out of control. The reason why the method of the control is varied in steps is to prevent the lower compression roller 95 from moving vertically quite a lot at once and to prevent hunting so that stability of control can be improved. An arrow A2 in FIG. 10 schematically shows a variation of the measured thickness controlled by this control. The base end of the arrow A2 shows the measured thickness WTave and the front end thereof shows a target value to be controlled.

Next, calibration of the reference value of pressure PO conducted in Step 7 S7 and Step 16 S16 will now be described. In this embodiment a variety of parameters are provided for a user's convenience or to select a suitable method of calibration to satisfy a purpose. The parameters are as follows:

(i) Number of Measurement of Pressure

The number of measurement of pressure can be set. In this embodiment it may be any number as far as the rotary table 3 makes one to nine rounds.

(ii) Range of Control Dead Zone

Figure 11:
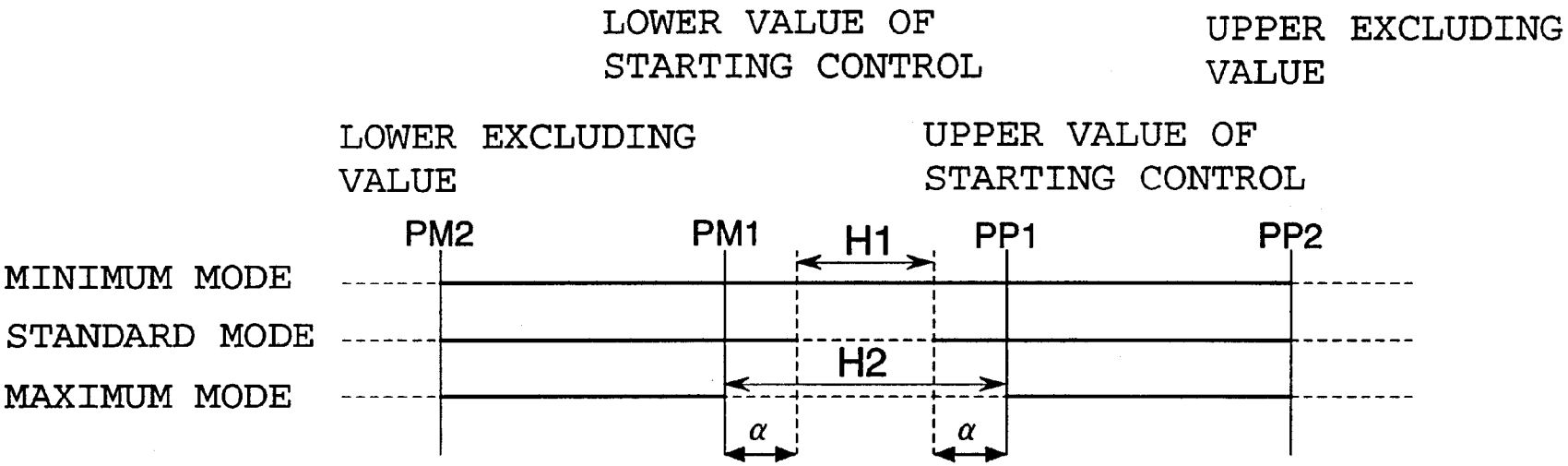
FIG. 11 is a schematic chart mainly showing ranges of a dead zone of each method for calibrating the reference value of weight in accordance with the embodiment.

A range of the control dead zone where no calibration is provided can be set based on an amount of deviation of the total average value of the measured pressure from the reference value of pressure PO set at present. In this embodiment the range of the control dead zone can be selected from three modes, namely, a minimum mode, a standard mode and a maximum mode as shown in FIG. 11. The minimum mode is set as the dead zone is zero. The standard mode is set as the range of the dead zone is a standard H1. The maximum mode is set as the range of the dead zone is the maximum H2. In FIG. 11 a solid line shows a range in which the control is carried out and a-dotted line shows a range in which no control is carried out. In this case α represents a value expressed by the next expression (7).

$$\alpha = (\text{upper value of starting control } PP1 - \text{lower value of starting control } PM1)/4 \quad (7)$$

(iii) Amount of Variation

An expression to calibrate the reference value of pressure PO can be selected from the next four expressions.

A. Shift—An amount of variation k, which is to calibrate the reference value of pressure PO, is found by the next expression (8) and added to the reference value of pressure PO so that the reference value of pressure PO is updated to a new reference value of pressure PO.

$$\text{amount of variation } k = \text{total average value of the measured pressure} - (\text{upper value of starting control } PP1 + \text{lower value of starting control } PM1)/2 \quad (8)$$

B. Proportion—An amount of variation k is found by the next equation (9) and multiplied by the reference value of pressure PO so that the reference value of pressure PO is updated to a new reference value of pressure PO.

$$\text{amount of variation } k = \text{total average value of the measured pressure}/\{(\text{upper value of starting control } PP1 + \text{lower value of starting control } PM1)/2\} \quad (9)$$

C. Automatic—The reference value of pressure PO is automatically updated by the third controller 113 with making use of the total average value of the measured pressure and the total average value of the standard deviation. More concretely, the method may be a suitable manner such as disclosed in Japanese Patent Publication No. 60-277334 by the same applicant as the present claimed invention.

D. Others—An amount is found by a process of another routine through the total average value of the measured pressure, the total average value of the standard deviation and the present reference value of pressure PO as a parameter and is updated to a new reference value of pressure PO.

(iv) Value to be Updated

A method for calibrating the upper value of starting control PP1, the upper excluding value PP2, the upper limit value of control range PP3, the lower value of starting control PM1, the lower excluding value PM2 and the lower limit value of control range PM3 can be selected from the following three.

A. All points—A calculation of (iii) is carried out to all of the above six points.

B. Four points—A calculation of (iii) is carried out to the upper and lower values of starting control PP1, PM1 and the upper and lower excluding values PP2, and PM2.

C. Two points—A calculation of (iii) is carried out to the upper and lower values of starting control PP1, PM1.

In accordance with the embodiment, since the tablet O is automatically sampled and the weight and thickness thereof are feedback-controlled, it is possible to correspond to a change such as expansion of the compressing component or fluctuation of the powder material flow, thereby to produce automatically high quality tablets O having a constantly uniform weight and thickness. As a result, productivity can be improved and the cost can be decreased because of full-automation. Conventionally experience of skilled operator is required for calibrating the reference value of pressure PO. However, since a method for calibration can be selected from several different methods in this embodiment, it is possible to calibrate the reference value of pressure PO optimally in spite of automation.

In addition, a plurality of tablets O are sampled and average values of weight and thickness of the sampled tablets O are calculated respectively by the measuring equipment and then the average values of weight and thickness are utilized as measured values of weight and thickness, thereby to prevent control from being unstabilized due to unevenness of each tablet O and as well as to improve accuracy in measurement.

This invention is not limited to the embodiments described in detail hereinabove. For example, the control flow is not limited to that shown in FIG. 7 and the mode to select a method for calibrating the reference value of pressure may be modified variously in addition to that shown in FIG. 11.

Moreover, each of the arrangements is not limited to that illustrated in the figures and there may be various modifications without departing from the spirit and essential characteristics thereof.

What is claimed is:

1. A compression molding machine for powder material comprising a compressing means which compresses powder material filled between compressing components so as to mold the powder material into a product by making the compressing components approach each other to a predetermined distance, an amount adjusting means which adjusts an amount of the powder material to be filled, a pressure detecting means which detects compressive pressure applied to the powder material by the compressing means, and a basic control means which controls the amount adjusting means so that the compressive pressure detected by the pressure detecting means becomes approximate to a reference value of compressive pressure which has previously been calculated in accordance with the predetermined reference amount of the powder material, further comprising a measuring means which samples the product automatically and measures weight and thickness of the sampled product, a position adjusting means which adjusts a predetermined distance between the compressing components, a weight control means which is used alternatively to the basic control means to control the amount adjusting means while basic control conducted by the basic control means is interrupted so that the weight of the product measured by the measuring means becomes approximate to a predetermined reference value of weight, a thickness control means which is used alternatively to the basic control means to control the position adjusting means while basic control conducted by the basic control means is interrupted so that the thickness of the product measured by the measuring means becomes approximate to a predetermined reference value of thickness and a reference pressure calibration means which calibrates the reference value of compressive pressure based on pressure measured at a time when both of the measured weight and thickness of the product are within the limits of tolerance set in accordance with the reference value of weight and thickness.

2. The compression molding machine for powder material, as described in claim 1, wherein the thickness control means controls the thickness of the product after the weight control means controls the weight of the product to be within the limits of tolerance of the reference value of weight.

3. The compression molding machine for powder material, as described in claim 1, wherein the measuring means calculates the average weight and thickness of a plurality of sampled products and the measured weight and thickness are average weight and thickness respectively.

4. The compression molding machine for powder material, as described in claim 1, wherein the measuring means samples the products at predetermined intervals.

5. The compression molding machine for powder material, as described in claim 1, wherein the weight control means operate in a plurality of steps based on an amount of deviation of the measured weight of the product from the reference value of weight.

6. The compression molding machine for powder material, as described in claim 2, wherein the thickness control means can operate in a plurality of steps based on an amount of deviation of the measured thickness of the product from the reference value of thickness.

7. The compression molding machine for powder material, as described in claim 1, further comprising a dead zone having the reference value of pressure being a center of the dead zone and no calibration of the reference value of pressure is conducted by the reference pressure calibration means if an amount of deviation of the measured pressure from the reference value of pressure is within the dead zone.

8. The compression molding machine for powder material, as described in claim 7, wherein a plurality of ranges of the dead zone can be set.

9. The compression molding machine for powder material, as described in claim 1, wherein the reference pressure calibration means can be selected from a plurality of predetermined methods.

10. The compression molding machine for powder material, as described in claim 2, wherein the measuring means calculates the average weight and thickness of a plurality of sampled products and the measured weight and thickness are the average weight and thickness respectively.

11. The compression molding machine for powder material, as described in claim 2, wherein the measuring means samples the products at predetermined intervals.

12. The compression molding machine for powder material, as described in claim 2, wherein the weight control means operate in a plurality of steps based on an amount of deviation of the measured weight of the product from the reference value of weight.

13. The compression molding machine for powder material, as described in claim 2, wherein the thickness control means can operate in a plurality of steps based on an amount of deviation of the measured thickness of the product from the reference value of thickness.

14. The compression molding machine for powder material, as described in claim 2, further comprising a dead zone having the reference value of pressure being a center of the dead zone and no calibration of the reference value of pressure is conducted by the reference pressure calibration means if an amount of deviation of the measured pressure from the reference value of pressure is within the dead zone.

15. The compression molding machine for powder material, as described in claim 2, wherein the reference pressure calibration means can be selected from a plurality of predetermined methods.

* * * * *